US010480182B2

(12) United States Patent
Fritschi et al.

(10) Patent No.: US 10,480,182 B2
(45) Date of Patent: Nov. 19, 2019

(54) ELEMENT FOR THERMAL INSULATION

(71) Applicant: Schock Bauteile GmbH, Baden-Baden (DE)

(72) Inventors: Hubert Fritschi, Baden-Baden (DE); Werner Venter, Buhl (DE); Andre Weber, Buhl (DE)

(73) Assignee: Schöck Bauteile GmbH, Baden-Baden (DE)

( * ) Notice: Subject to any disclaimer, the term of this patent is extended or adjusted under 35 U.S.C. 154(b) by 0 days.

(21) Appl. No.: 15/657,579

(22) Filed: Jul. 24, 2017

(65) Prior Publication Data

US 2018/0023288 A1 Jan. 25, 2018

(30) Foreign Application Priority Data

Jul. 22, 2016 (DE) ..... 10 2016 113 558
Jul. 22, 2016 (DE) ..... 10 2016 113 559

(51) Int. Cl.
*E04B 1/76* (2006.01)
*E04B 1/00* (2006.01)
(Continued)

(52) U.S. Cl.
CPC ..... *E04B 1/767* (2013.01); *E04B 1/0038* (2013.01); *E04B 1/76* (2013.01); *E04B 1/7637* (2013.01);
(Continued)

(58) Field of Classification Search
CPC ..... E04B 1/0038; E04B 1/76; E04B 1/7637; E04B 1/7675; E04B 2/40
See application file for complete search history.

(56) References Cited

U.S. PATENT DOCUMENTS 4,620,401 A 11/1986 L'Esperance et al.
4,959,940 A * 10/1990 Witschi ..... E04B 1/0038 52/223.13
(Continued)

FOREIGN PATENT DOCUMENTS

AT 514343 12/2014
CH 691606 A5 * 8/2001 ..... E04B 1/0038
(Continued)

OTHER PUBLICATIONS

Michiels Pierre, Machine Translate for EP2060687 (Year: 2009).*
(Continued)

*Primary Examiner* — Babajide A Demuren
(74) *Attorney, Agent, or Firm* — Volpe and Koenig, P.C.

(57) ABSTRACT

An element for thermal insulation between two building parts, particularly between a building (A) and a protruding exterior part (B), comprising an insulating body (2) to be arranged between the two building parts and reinforcement elements in the form of at least tensile elements (3), extending in an installed state of the element (10) essentially horizontally and perpendicular to an essentially horizontal extension of the insulating body through said body, and respectively projecting in the horizontal direction from the insulating body and here allowing a connection to one of the two building parts preferably made from concrete. Here the tensile reinforcement elements (3) are formed as multi-part composite elements such that at least in the proximity of the insulating body (2) they have a central rod section (3*a*) made from fiber-reinforced synthetic material and have a separate anchoring rod section (3*b*) in an area outside the insulating body (2) with geometric and/or material characteristics at least partially deviating from the central rod section (3*a*), with the anchoring rod section (3*b*) and the central rod section being arranged at least essentially aligned to each other and at least indirectly fixed to each other, and with the
(Continued)

anchoring rod section (3*b*) cooperating with an interior anchoring element for fixing at the central rod section (3*a*), which interior anchoring element engages a radially interior area of the central rod section. The central rod section (3*a*) comprises on its radial exterior an annular radial support element and/or a radial support area (3*ab*) with fibers (3*f*) extending at least partially in the circumferential direction of the central rod section (3*a*), with the interior anchoring section (3*v*) and the radial support area (3*ab*) at least partially overlapping each other.

19 Claims, 4 Drawing Sheets

(51) Int. Cl.

| | |
|---|---|
| ***E04B 2/40*** | (2006.01) |
| ***E04C 2/22*** | (2006.01) |
| ***E04C 2/24*** | (2006.01) |
| ***E04C 5/12*** | (2006.01) |
| ***E04C 5/16*** | (2006.01) |
| ***E04C 5/07*** | (2006.01) |
| *E04B 1/19* | (2006.01) |
| *E04B 1/74* | (2006.01) |

(52) U.S. Cl.
CPC ..... *E04B 1/7675* (2013.01); *E04B 2/40* (2013.01); *E04C 2/22* (2013.01); *E04C 2/243* (2013.01); *E04C 5/07* (2013.01); *E04C 5/127* (2013.01); *E04C 5/166* (2013.01); *E04B 2001/1996* (2013.01); *E04B 2001/742* (2013.01); *E04B 2103/04* (2013.01); *E04C 5/165* (2013.01)

(56) References Cited

U.S. PATENT DOCUMENTS

| | | | | |
|---|---|---|---|---|
| 8,875,458 | B2 * | 11/2014 | Fritschi | E04B 1/003 52/259 |
| 2010/0031607 | A1 | 2/2010 | Oliva et al. | |
| 2010/0095616 | A1 * | 4/2010 | Braasch | C04B 26/10 52/291 |
| 2014/0202102 | A1 * | 7/2014 | Braasch | E04B 1/7604 52/407.1 |

FOREIGN PATENT DOCUMENTS

| | | | | |
|---|---|---|---|---|
| CH | 699960 | A1 * | 5/2010 | E04B 1/0038 |
| CH | 711841 | B1 * | 5/2017 | E04B 1/0038 |
| DE | 3422905 | A1 * | 1/1986 | E04B 1/0038 |
| DE | 3446006 | A1 * | 7/1986 | E04B 1/0038 |
| DE | 277304 | | 3/1990 | |
| DE | 4427962 | A1 * | 2/1996 | E04B 1/0038 |
| DE | 19501824 | A1 * | 7/1996 | E04B 1/0038 |
| DE | 29707378 | U1 * | 6/1997 | E04B 1/0038 |
| DE | 29805137 | U1 * | 5/1998 | E04B 1/0038 |
| DE | 19947912 | | 5/2001 | |
| DE | 19947912 | A1 * | 5/2001 | E04B 1/0038 |
| DE | 19947913 | | 5/2001 | |
| DE | 10161481 | A1 * | 6/2003 | E04B 1/0038 |
| DE | 102004038082 | | 3/2006 | |
| DE | 102006032444 | A1 * | 1/2008 | E04B 1/0038 |
| DE | 102006056916 | A1 * | 6/2008 | E04B 1/0038 |
| DE | 102008049868 | A1 * | 4/2009 | E04B 1/0038 |
| DE | 102008018325 | | 10/2009 | |
| DE | 102010034514 | A1 * | 3/2012 | E04B 1/0038 |
| DE | 202012101574 | | 8/2012 | |
| DE | 102011122589 | A1 * | 7/2013 | E04B 1/0038 |
| DE | 202013006229 | U1 * | 10/2014 | E04B 1/0038 |
| EP | 1088943 | A2 * | 4/2001 | E04B 1/0038 |
| EP | 1148179 | A1 * | 10/2001 | E04B 1/0038 |
| EP | 1564336 | A1 * | 8/2005 | E04B 1/0038 |
| EP | 1627971 | A1 * | 2/2006 | E04B 1/0038 |
| EP | 2000605 | | 12/2008 | |
| EP | 2557243 | A2 * | 2/2013 | E04B 1/0038 |
| JP | 3958335 | B2 * | 8/2007 | E04B 1/0038 |
| WO | 2005035892 | | 4/2005 | |
| WO | WO-2005035892 | A1 * | 4/2005 | E04B 1/0038 |
| WO | 2012071596 | | 6/2012 | |

OTHER PUBLICATIONS

Michiels Pierre, Machine Translate for EP2000605 (Year: 2008).*
Halfen GmbH & Co KG, Machine Translate for DE29707378 (Year: 1997).*

* cited by examiner

ELEMENT FOR THERMAL INSULATION

INCORPORATION BY REFERENCE

The following documents are incorporated herein by reference as if fully set forth: German Patent Application No. DE 102016113559.3, filed Jul. 22, 2016; and German Patent Application No. DE 102016113558.5, filed Jul. 22, 2016.

BACKGROUND

The present invention relates to an element for thermal insulation between two building parts, particularly between a building and a protruding exterior part, comprising an insulating body to be allocated between the two building parts and reinforcement elements in the form of at least rod-shaped tensile reinforcement elements, which in an installed state of the element extend essentially horizontally and extend perpendicular to an essentially horizontal extension of the insulating body through said body.

Various embodiments of elements for thermal insulation are known from prior art, which primarily serve to support building parts projecting from buildings, such as balcony plates, through a thermally insulating building joint. Here, the integrated reinforcement elements ensure the necessary transfer of the force and/or moment, while the insulating body is responsible to separate the two building parts from each other in a thermally insulating fashion while maintaining the joint.

In general, in relevant prior art tensile reinforcement elements are provided, usually produced from a rod-like material made from metal, which particularly in the proximity of the insulating body are made from stainless steel and in the area outside the insulating body are made from rebar. Stainless steel is used in the proximity of the insulating body and/or the building joint on the one hand due to its resistance to corrosion and on the other hand due to its poor thermal conductivity, and thus it is preferred over rebar in the proximity of the insulating body. However, rebar is commonly used in the area outside the insulating body, where neither resistance to corrosion nor thermal insulating features are relevant, since the rebar extends completely inside one of the two building parts.

Recently it has been attempted to further optimize the elements for thermal insulation, with it being tried to produce the tensile reinforcement elements, previously made almost exclusively from metal, now from a synthetic material, because it is considerably more cost effective than stainless steel and additionally it exhibits even lower thermal conductivity than stainless steel. An example for such an element for thermal insulation with tensile reinforcement elements made from a synthetic material is discernible from DE-U 20 2012 101 574. The tensile reinforcement elements called in this publication tensile release rods are made from fiberglass-reinforced synthetic, allowing two adjacent rods to be respectively connected to each other at their ends via a lateral plate, in order to yield a higher and more stable transfer of tensile forces. It is easily discernible from this type of anchoring of two tensile release rods via a lateral plate, that it is cumbersome and causes installation problems when connecting the reinforcement element, and that tensile reinforcement elements made from a synthetic are hard to anchor in the adjacent building parts particularly when, as in the described prior art, they are embodied with smooth walls and thus a type of end anchoring is required in the form of a lateral plate.

An alternative solution for the use of tensile reinforcement elements made from fiberglass or carbon fiber reinforced synthetic material is discernible from WO-A 2012/071596, in which the tensile reinforcement elements are made from closed loops, which based on their shape as a loop enter into a positive connection to an abutting building part and this way ensure the required anchoring. Looped tensile reinforcement elements have repeatedly been suggested in prior art; however due to their limited anchoring depth in the abutting building part and the here resulting low capacity to transfer strong tensile forces they exhibit considerable disadvantages, with the loop shape itself regularly resulting in a collision with the abutting reinforcement and thus leading to installation problems, similar to the above-described lateral plates.

These elements for thermal insulation with reinforcement elements made from a synthetic material were previously not convincing because their anchoring in the abutting building parts failed to attain the problems left unsolved in the past: Here, either the tensile reinforcement elements must generate via special geometries (e.g., by a loop form, lateral plates, and the like) a strong positive connection to the abutting building part, which in turn leads to installation problems due to the connecting reinforcement to be arranged in this area; or it must be attempted to provide the tensile reinforcement elements comprising a fiber-reinforced synthetic in the form of a tubular and/or rod material with a profiling and/or striation at their exterior, with here however the anchoring of these profiled tensile reinforcement elements made from a synthetic material in the abutting building part suffering the disadvantage that the fiber-reinforced synthetic on the one side and the concrete material of the abutting building part on the other side show generally such distinctly different temperature expansion coefficients that automatically different, temperature-related relative movements develop, which lead to tensions and/or expansions in the mutual contact area. This leads to destructions by either the profiling or the so-called concrete bases between the profiling shearing off. This results in the tensile reinforcement elements usually losing their ability to fulfil their function.

Another disadvantage of tensile reinforcement elements made from a synthetic material is the lack of subsequent bending property, compared to steel, which renders it necessary that the desired shape and length of the tensile reinforcement elements is already considered during the production of the rods. This leads to a considerably increased number of tensile reinforcement elements that need to be warehoused due to the accordingly high number of variants, which causes disadvantages with regards to logistics.

SUMMARY

Based on this prior art, the objective of the present invention is to improve an element for thermal insulation by particularly avoiding the above-described disadvantages of tensile reinforcement elements made from a synthetic material and particularly allowing improved anchoring of the tensile reinforcement elements in the adjacent concrete building parts.

This objective is attained according to the invention in an element for thermal insulation comprising one or more features of the invention.

Advantageous variants of the invention are respectively the objective of the dependent claims, with their wording here being explicitly included in the description by way of reference in order to avoid unnecessary text repetitions.

In the first solution according to the invention it is provided that the tensile reinforcement elements are embodied here as multi-part composite elements, that they comprise at least in the proximity of the insulating body a central rod section made from a fiber-reinforced synthetic material, and in an area outside the insulating body show a separate anchoring rod section with geometric and/or material features at least partially deviating from the central rod section, that the anchoring rod section and the central rod section are arranged at least essentially in a mutually aligned fashion and can be fixed to each other at least indirectly, that the anchoring rod section for fastening to the central rod section cooperates with an internal anchoring element, which engages a radially interior area of the central rod section, and that the central rod section exhibits on its radial exterior an annular radial support element.

In the second solution according to the invention it is provided that the tensile reinforcement elements are here embodied as multi-part composite elements, that they have at least in the proximity of the insulating body a central rod section made from a fiber-reinforced synthetic material and in an area outside the insulating body a separate anchoring rod section with geometric and/or material features at least partially deviating from the central rod section, that the anchoring rod section and the central rod section are arranged at least essentially aligned to each other and can be fixed in reference to each other at least indirectly, that the anchoring rod section for fastening at the central rod section cooperate with an interior anchoring element, which engages a radial interior area of the central rod section, and that the central rod section comprises a radial support area with fibers extending at least partially in the circumferential direction of the central rod section, with the interior anchoring area and the radial support area at least partially overlapping in the radial direction.

The material combination of the multi-part composite element is based on the acknowledgement that it is not necessary to forgo the particular advantages of synthetic materials in the proximity of the insulating body only because in the proximity of the abutting building part the synthetic material, due to the anchoring problems, is preferably replaced perhaps by different materials and/or geometries, particularly profiled steel. The result is therefore the above-mentioned multi-part composite element with an unusual component mix, which at least in the proximity of the insulating body comprises a corrosion-resistant and very poorly thermally conducting, fiber-reinforced synthetic material, and outside the insulating body shows other geometric or material features, and this way it can be adjusted to the installation conditions at the abutting building parts. This has proven successful in case of the conventional metal-tensile rods, which commonly have in the proximity of the insulating body a central rod section made from stainless steel and outside the insulating body have anchoring rod sections made from rebar.

This composite element surprisingly exceeds the tensile reinforcement elements known from prior art in every aspect, since it allows to select the materials used in the insulating body and/or the abutting building parts according to the individual advantages for the different requirements given and to disregard disadvantageous materials and/or geometries. This way in the proximity of the insulating body a central rod section made from fiber-reinforced synthetic can be used, which is more cost-effective and is considerably less thermally conductive than the stainless steel used in prior art, while in the proximity of the abutting concrete parts no particular requirements are given with regards to thermal conductivity and thus cost-effective, easily handled and subsequently bendable rebar rods can be used, which can ensure with appropriate exterior profiling an optimal anchoring in the abutting concrete building parts using simple and cost-effective measures.

As already mentioned the anchoring rod section and the central rod section are arranged in a mutually aligned fashion and at least indirectly fixed to each other. This must occur in such a fashion that the mutual connection of the central rod section and the anchoring rod section can reliably transfer the tensile forces developing here. In order to achieve this goal the present invention provides that the anchoring rod section for fixing at the central rod section cooperates with an interior anchoring element, which engages a radial interior area of the central rod section, and that in a first solution according to the invention the central rod section has on its radial exterior an annular radial support element and/or that in a second solution according to the invention the central rod section has a radial support area comprising fibers, which extend at least partially in the circumferential direction of the central rod section, with the interior anchoring area and the radial support area overlapping at least partially in the radial direction.

The use and fixation of the interior anchoring element in the central rod section alone would be insufficient perhaps in the fiber-reinforced synthetic material of the central rod section used in order to transfer the developing tensile forces without causing any destruction. For this reason, the annular radial support element is provided at the radial exterior of the central rod section and ensures this way that the central rod section cannot expand in the radial direction and/or fray and/or delaminate. The radial support element therefore encompasses the central rod section like the ring of a barrel and compensates lateral forces potentially acting in the radial direction, which are transferred from the interior anchoring element to the central rod section.

The radial support element can perform its function in a particularly effective and reliable fashion if the radial support element is arranged in the same axial section as the central rod section in which also the interior anchoring element is located. Here the radial support element overlaps the interior anchoring element with the central rod section being interposed and ensures by the support that the connection between the interior anchoring element and the central rod section remains upheld because the central rod section, in case of tensile stress developing, cannot deflect outwardly in the radial direction.

Beneficially the interior anchoring element and/or the radial support element extend to the free end of the central rod section, at which the central rod section is fixed to the anchoring rod section; because particularly at the free end the radial support is most important, because here the central rod section is not held in the axial direction and this way the radial support element can counteract a radial widening.

In order to avoid unnecessarily material bulging at the central rod section and thus correspondingly worsened thermal insulating characteristics it is recommended that the radial support element and/or the radial support section are arranged only in the axial area of the central rod section projecting beyond the insulating body. Because if the annular radial support element or the additional fibers of the radial support section were to extend at least partially in the circumferential direction of the central rod section, reach into the axial area of the insulating body or even, upon crossing it, project beyond the other side of the central rod in reference to the insulating body, here automatically the material cross-section of the central rod section was increased in the area of the insulating body and thus an additional thermal bridge was created, which is particularly to be avoided by the use of the fiber-reinforced synthetic material for the central rod section. It is even more advantageous in this context for the radial support element and/or the radial support section to be arranged even slightly distanced from the insulating body, in order to avoid any potential thermal bridge effects with regard to potential covers of the insulating body.

In order to ensure the precise positioning of the annular radial support element and thus also its reliable function it is recommended for the radial support element to exhibit a stop projecting inwardly in the radial direction and said stop to impinge the face of the central rod section located at the free end of the central rod section at least indirectly. This stop ensures not only that the radial support element is arranged precisely in the overlapping area with the internal anchoring element but also that the radial support element during transportation and in the installed condition cannot slip in the axial direction out of the intended end position.

If applicable, the stop of the annular radial support element can also be connected, at least indirectly, to the interior anchoring element, also ensuring protection from loss and a fixed position of the radial support element.

Similar effects and advantages are yielded by the radial support section of the central rod section with fibers extending at least partially in the circumferential direction of the central rod section, with the internal anchoring area and the radial support area at least partially overlapping each other and particularly the interior anchoring area and the radial support area being at least partially arranged in the same axial section of the central rod section.

Here the fibers extending in the circumferential direction of the central rod section, preferably arranged in the radial exterior area of the central rod section, ensure that the connection between the interior anchoring element and the central rod section remain upheld because the central rod section cannot deflect outwardly in the radial direction upon tensile stress developing.

Beneficially the interior anchoring area and/or the radial support area extend to the free end of the central rod section at which the central rod section is fixed at the anchoring rod section; because particularly at the free end the radial support is most important, because here the central rod section is not held in the axial direction and this way the fibers extending in the radial direction can compensate a radial widening.

Due to the fact that the tensile reinforcement elements usually extend between the two building parts abutting the element for thermal insulation and project sufficiently far into these building parts in order to allow entering into a tensile-force transferring anchoring with the building parts it is recommended for the central rod section of a tensile reinforcement element to show at its two free ends one anchoring rod section each. This way, the advantages of the composite element can be utilized in both building parts and thus at both ends of the tensile reinforcement elements.

Due to the fact that the rebar at the end of the anchoring sections, for reasons of protection from corrosion, must have at least a minimum extent of concrete coverage the anchoring rod sections, to the extent they are made from steel and particularly rebar, may not extent all the way to the insulating body in order to prevent that the anchoring rod sections corrode. Here the fixation of the anchoring rod section at the central rod section outside the insulation body must occur in an area which is protected from corrosion by the minimum concrete coverage required.

The separation of the connection area from the insulating body can however be utilized for another essential effect and advantage. Beneficially the central rod section can be embodied on its radial exterior essentially with a smooth wall at least in the area between the insulating body and its free end. This way any excessive bonding between the central rod section and the material of the abutting building part surrounding the central rod section is avoided and a buffer zone is formed, which ensures that the bending stiffness of the tensile reinforcement elements changes not abruptly but only gradually upon leaving the insulating body and entering the abutting building part. Because an abrupt leap in stiffness would generate excessive stress in the tensile reinforcement element as well as the frontal edge of the building parts abutting: On the one hand, excessive stress can lead to a delamination of the tensile reinforcement element made from fiber-reinforced synthetic material; on the other hand the building material at the frontal edge of the abutting building part can split off, which in turn reduces and/or destroys the required minimum concrete coverage and thus would void the protection from corrosion for the tensile reinforcement element.

The central rod section, essentially having a smooth wall, serves therefore to prevent any anchoring of the tensile reinforcement element in the abutting building part near the joint such that the anchoring occurs only in the connection area at the anchoring rod section as well as the anchoring rod section itself. By moving the connection area away from the edge section and/or the insulating body near the joint into the abutting building part the length of the sections of the tensile reinforcement element with reduced bending stiffness is enlarged. This way the tensile reinforcement elements clamped in this fashion overall are more flexible and thus better capable to follow temperature-related relative movements between the adjacent building parts in the lateral and/or shifting direction. This increase of the bending and/or shifting flexibility prevents any excessively fast and/or strong fatigue of the tensile reinforcement elements developing.

While in prior art instructions can be found to the effect that the free, i.e. not radially supported length of a tensile reinforcement element comprising a fiber-reinforced synthetic material between the two clamping sites must be sized as short as possible in order to keep the overall expansion of the tensile reinforcement element in the axial direction as short as possible, the object of the present invention intentionally accepts such an increase of the axial expansion by shifting the clamping sites away from the insulation body into the adjacent building parts in order to design the tensile reinforcement elements more flexible, which results ultimately in the desired advantageous reduction of material fatigue.

In other words: If, as common in prior art, a tensile reinforcement element comprising a synthetic material was provided with a profiled casing area and inserted directly into an abutting concrete part and anchored there, the section with reduced bending stiffness would be limited to the dimensions of the insulating body. It is obvious that such an excessively rigid tensile reinforcement element would not be capable to sufficiently follow the common temperature-based relative movements of the two abutting components. Simultaneously, the tensile reinforcement element would exhibit a change in stiffness in the transitioning area between the insulating body and the abutting building part by the abrupt transition between the different surrounding materials, which then resulted in excessive stress of the tensile reinforcement elements, perhaps leading to destructions, as well as the material of the abutting building part.

In order to allow providing the necessary anchoring of the tensile reinforcement elements in the abutting building parts in the installed condition the anchoring rod section should extend starting from the connection area with the central rod section in the horizontal direction over a length $L_3$, which is at least twenty times the size of the diameter $d_y$ of the anchoring rod section. This ensures that the tensile reinforcement elements according to the invention can be used without any anchoring elements at the ends, such as lateral plates, loops etc., and still allow ensuring the desired anchoring and allow even in light of the background that the smooth-walled section of the central rod section between the insulating body and the connection area hardly contribute to the anchoring effect and the connection area itself not at all.

Similar to the tensile reinforcement elements of prior art here too the possibility is given to produce the tensile reinforcement element from a tubular or rod-like material, namely both in the proximity of the anchoring rod section as well as primarily also in the proximity of the central rod section. In case of the central rod section however, in case of the use of a tubular material, it must be ensured that the interior anchoring element can be fixed and anchored reliably on the radial interior side of the central rod area.

With regards to the materials of the multi-part composite element, thus the tensile reinforcement element, it is preferred that the anchoring rod section is made from rebar, which shows a temperature extension coefficient, thus a thermal expansion in the dimension of the temperature extension coefficient and/or the thermal expansion of concrete and thus it can follow the deformations and/or expansions of the concrete, caused by temperature, and therefore remain free from destructions. Furthermore, it is preferred that the central rod section of the tensile reinforcement element is made from a fiberglass-reinforced synthetic material, which on the one hand is sufficiently resilient in the direction of tensile stress and on the other hand shows poor thermal conductivity, which is desired in the proximity of the insulating body. It shall be pointed out that the formulation "fiber-reinforced synthetic material" also includes such fiber reinforcements, particularly fiberglass reinforcements, with their fiber ratio, particularly fiberglass ratio exceeding 85% by weight, so that the weight of the matrix material used in addition to the fibers, such as synthetic resin, amounts to less than 15% compared to the weight of these reinforcement elements.

Due to the fact that the anchoring rod sections are made preferably from steel, they can be anchored in the abutting building parts in a conventional fashion, without this, as in case of fiber-reinforced synthetic rods, being required to be compensated by exotic deformations (in the form of the above-mentioned lateral plates, loops, etc.) and the installation problems with the connecting reinforcements caused thereby, or when using profiled synthetic rods, due to damages in the mutual contact area, which are triggered by the different expansion coefficients of concrete on the one side and the synthetic rod on the other side. In case of reinforcement rods made from steel however such anchoring occurs usually by profiling the casing area of the reinforcement rods, allowing this profiling to be provided easily during the production process of these reinforcement elements.

With regards to the annular radial support element, this should be made preferably from metal, and particularly from stainless steel. Primarily when the distance of the axial position of the radial support element from the insulating body and/or the building joint is relatively small, here sufficient concrete coverage must be ensured in order to avoid any corrosion of the radial support element.

Alternatively the annular radial support element may be made from a synthetic material and particularly from a fiber or fiberglass reinforced synthetic, which of course is primarily advantageous with regards to the problem of corrosion.

Similar to the fibers of the central rod section it is recommended that the fibers, which extend in the radial support area at least partially in the circumferential direction of the central rod section, that these fibers represent fiberglass. Additionally, advantages result when colored fibers are used in somewhat transparent matrix material of the central section in order to this way allowing that the radial support area is easily identified from the outside, and this way the correct assembly of the anchoring section and the central section is facilitated.

For the function of the composite element according to the invention it is particularly important that the anchoring rod section and the central rod section are fixed to each other in a reliable and strong fashion. For this purpose it is recommended that the interior anchoring element is fixed in a form-fitting, force-fitting and/or material-to-material fashion and particularly via an adhesive connection and/or a threaded connection in the central rod section. This occurs generally only shortly before the anchoring rod is to be fastened at the central rod section. Similarly, the internal anchoring element can be fixed and/or anchored also at an earlier point of time and particularly also already during the production of the central rod section in said central rod section, for example by forming it therein during the extrusion process, particularly laminating it therein.

Depending on the type of fixation of the interior anchoring element in the central rod section, here various connection technologies are possible for fixing the interior anchoring element at the anchoring rod section. For example, it can occur in a form-fitting, force-fitting, and/or material-to-material process and particularly it can be fixed via a welding connection at the anchoring rod section. A welded connection is particularly beneficial when the interior anchoring element is formed inside the central rod section and represents a so-called welding insert. Here, the anchoring rod section can be connected at the welding insert via induction welding, laser welding, or similarly suited welding methods.

Another advantageous connection technology comprises that the interior anchoring element is formed in one piece at the anchoring rod section and/or is a part of the anchoring rod section. In this case the anchoring rod section can be inserted together with the interior anchoring element into the central rod section and here be fixed. When the interior anchoring element shows an external thread the anchoring rod section can be screwed together with the interior anchoring element into the central rod section.

In order to ensure fixation of the anchoring rod section at the central rod section with sufficient tensile strength, it is recommended for the interior anchoring element to engage the radial interior area of the central rod section over an axial length $L_5$, which is at least 4-times and particularly preferred at least 5-times the size of the diameter $d_M$ of the central rod section. For the first solution according to the invention it is additionally recommended that simultaneously (or alternatively) the annular radial support element shows a length $L_4$ in the axial direction, which is at least 1.5 times and particularly preferred 2-times the size of the diameter $d_M$ of the central rod section.

In case of the second solution according to the invention it is recommended that the radial support area with fibers extending at least partially in the circumferential direction of the central rod section shows a length $L_2$ in the horizontal direction, which is at least 1.5-times, and particularly preferred at least 2-times and maximally 15-times, and particularly preferred maximally 12-times the size of the diameter dv of the anchoring section.

In order to allow providing the required anchoring of the tensile reinforcement elements in the adjacent building parts in the installed state the anchoring rod section should, starting from the connection area, extend in the horizontal direction over a length $L_3$, which is at least 15-times and particularly preferred at least 20-times the size of the diameter $d_V$ of the anchoring section. This way it is ensured that the tensile reinforcement elements according to the invention can be used without requiring anchors at their ends, such as lateral plates, loops, etc. and still ensure the desired anchoring effect, and this even in light of the background that the smooth-walled section of the central section between the insulating body and the connecting body contributes not and the connection area itself contributes hardly to the anchoring effect.

The element for thermal insulation according to the invention beneficially comprises, in addition to the tensile reinforcement elements, as known from the related prior art and common in such elements for thermal insulation, compression elements and/or lateral force elements for transferring compressive and/or lateral forces between the adjacent building parts.

To the extent that here the material of the adjacent building part is discussed, thus particularly of the building and the projecting exterior part made from concrete, this shall be understood as any form of a building material that can cure and/or set, particularly a cement-containing, fiber-reinforced construction material such as concrete, high-strength or ultrahigh-strength concrete, or high-strength or ultrahigh-strength mortar, a synthetic resin mixture, or a reaction resin molding mixture.

BRIEF DESCRIPTION OF THE DRAWINGS

Additional features and advantages of the present invention are discernible from the following description of exemplary embodiments based on drawings; shown here are.

DETAILED DESCRIPTION OF THE PREFERRED EMBODIMENTS

Figure 1:
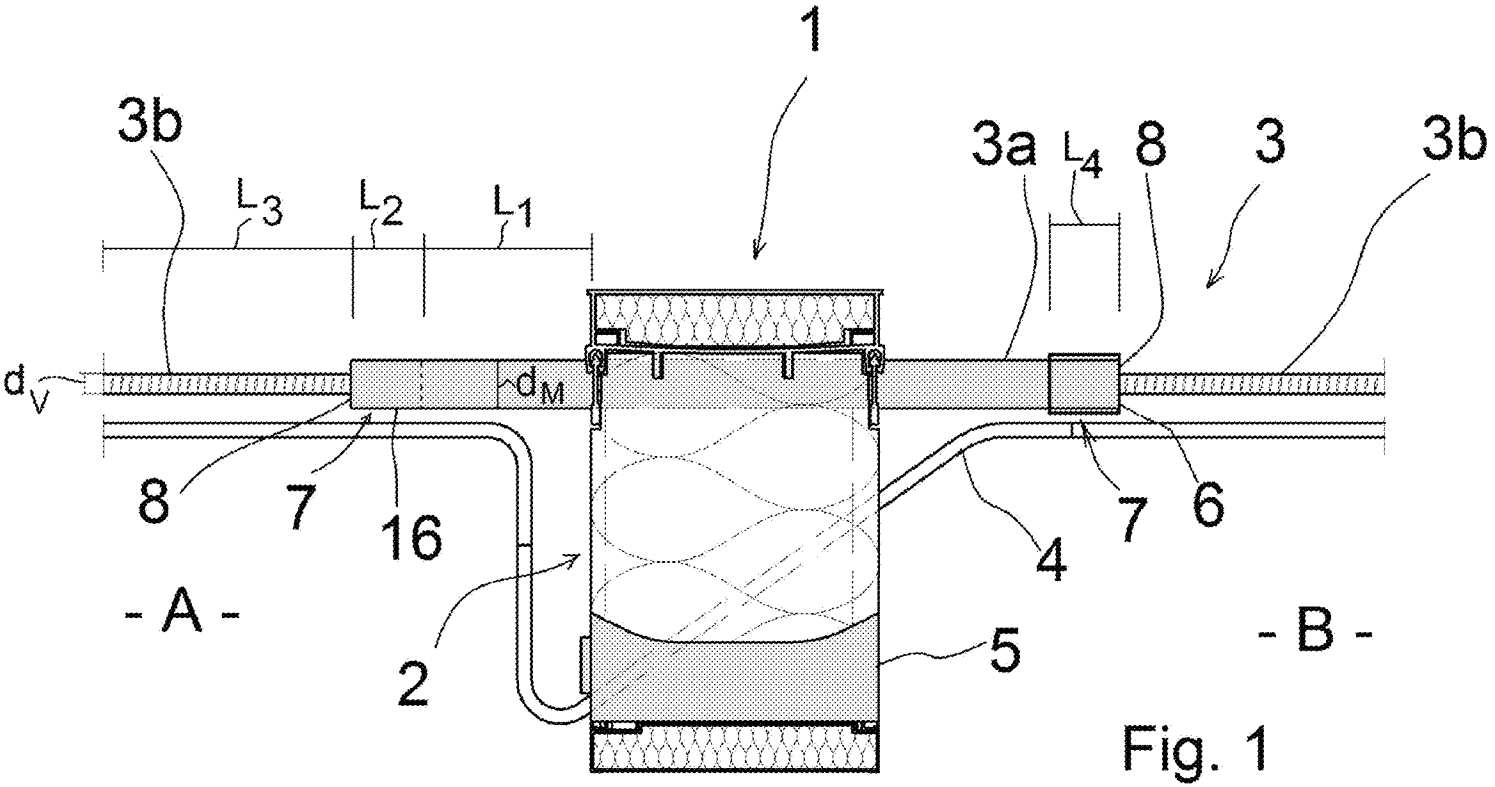
FIG. 1 an element for thermal insulation according to the invention in a schematic and partially cross-sectioned side view.

FIG. 1 shows an element for thermal insulation 1 with a multi-part cuboid-shaped insulating body 2, which is provided for an arrangement in a building joint remaining between two concrete building parts (which are not shown here, but with their position being indicated by the reference characters A, B) for the purpose to distance these to concrete building parts A, B from each other in a thermally insulating fashion. The insulating body 2 is assembled from several parts, in order to allow the installation of reinforcement elements in the form of tensile rods 3, in the form of lateral force rods 4, and in the form of compression elements 5.

The arrangement of the reinforcement elements occurs in a manner known from prior art and common, namely by arranging the tensile reinforcement elements 3 in the upper area, the so-called tensile zone of the insulating body 2, which in the installed state extend in the horizontal direction and serve for the transfer of tensile forces between the two building parts A, B connected to the element for thermal insulation and for this purpose are anchored in these building parts. In the lower section, the so-called pressure zone of the insulating body 2, the pressure elements 5 are arranged, namely also in the horizontal direction of extension, with them however not or hardly projecting from the insulating body 2. Finally, lateral force rods 4 are provided, which extend in the area inside the insulating body 2 in an inclined fashion in reference to the horizontal and extend from the reinforcement elements of the element for thermal insulation diagonally downwards, matching the stress to be compensated, from the tensile zone on one side of the insulating body to the pressure zone on the other size of the insulating body, in order to here extend vertically in the direction of the tensile zones angled upwards and then, after another angle, parallel to the tensile reinforcement elements.

The tensile reinforcement elements 3 are essential for the present invention, which are embodied as multi-part composite elements with a rod-shaped central rod section 3*a* made from a fiber reinforced synthetic material and rod-shaped anchoring rod sections 3*b* made from rebar. The central rod section 3*a* extends in the area of the insulating body 2 in the horizontal direction and projects slightly in the horizontal direction at both sides of the insulating body respectively with its free end 7, with the section respectively projecting here being arranged in the installed state in the proximity of the adjacent building parts A, B. Both anchoring rod sections 3*b* are arranged aligned to the central rod section 3*a* and respectively fastened at one of the two free ends 7 of the central rod section 3*a*.

The central rod section 3*a* comprises at its radial exterior, in the proximity of the free ends 7*a* on the one side, namely at the free end 7 at the right side in FIG. 1, an annular radial support element 6, which contacts in a planar fashion the exterior jacket of the central rod section and is fastened in this position by way of adhesion. This radial support element 6 is discussed in greater detail in the context with the embodiment according to FIG. 2. And at the other side, namely at the free end 7 of the central rod section 3*a* left in FIG. 1, a radial support section 16 is shown, which is discussed in greater detail in the context with the embodiment according to FIG. 3.

The axial size by which the central rod section 3*a* projects beyond the insulating body 2 amounts to $L_1+L_2$, with the length $L_1$ being equivalent to the axial distance of the radial support element 6 from the insulating body 2, the length $L_2$ equivalent to the length of the radial support area 16 in the axial direction, as well as the length $L_4$ equivalent to the length of the radial support element 6 in the axial direction, with the lengths $L_2$ and $L_4$ being identical in size in FIG. 1.

The length $L_3$ finally provides the size by which the anchoring rod section 3*b*, starting from the radial support element 6 and/or the facial side 8 of the central rod section 3*a*, extends into the building part A. FIG. 1 shows here not the full length of the anchoring rod section 3*a* and thus the size of the length $L_3$ in FIG. 1 is not equivalent to the overall length of the anchoring rod section 3*b*, either.

The central rod section 3*a* has a diameter $d_M$, which is greater than the diameter $d_V$ of the anchoring rod section 3*b*.

Figure 2:
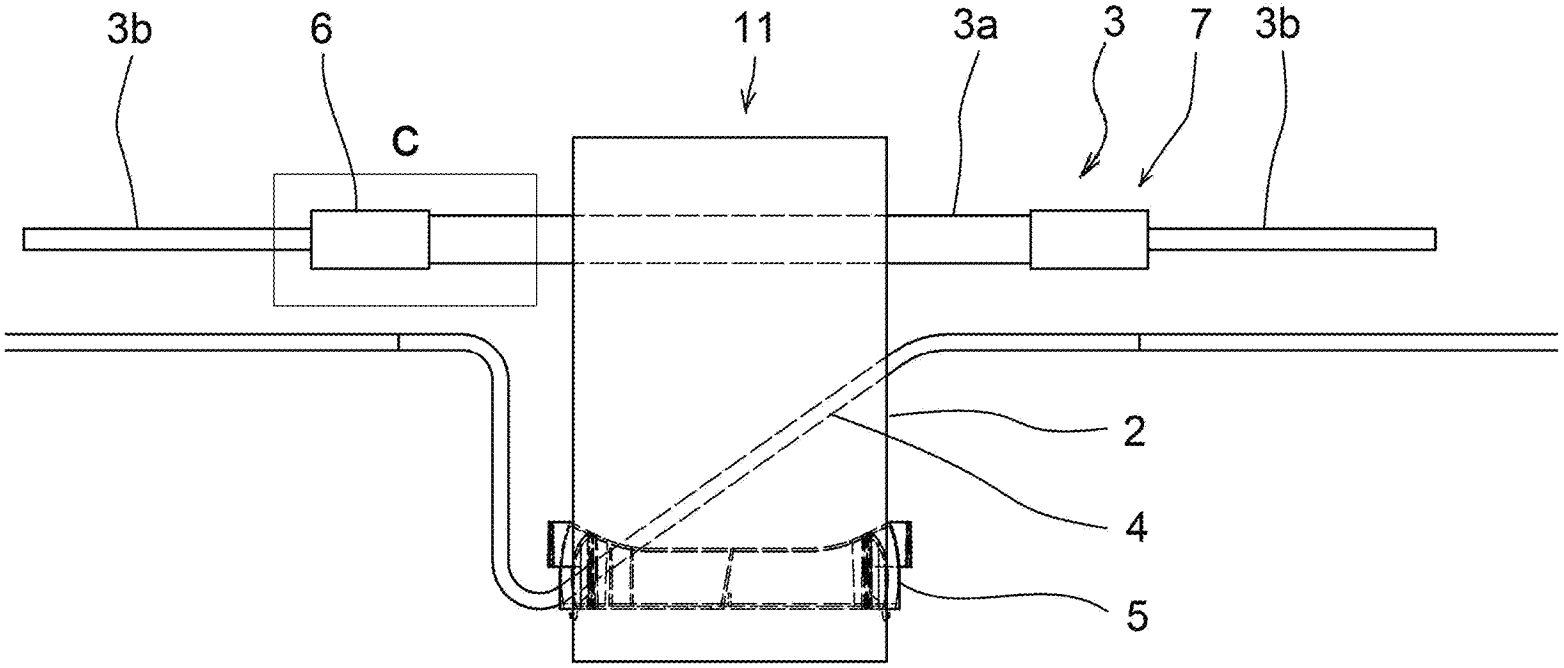
FIGS. 2 and 2A an alternative element for thermal insulation according to the invention with a first embodiment for the mutual fixation of a central rod section and an anchoring rod section according to a first solution according to the invention.
Figure 2A:
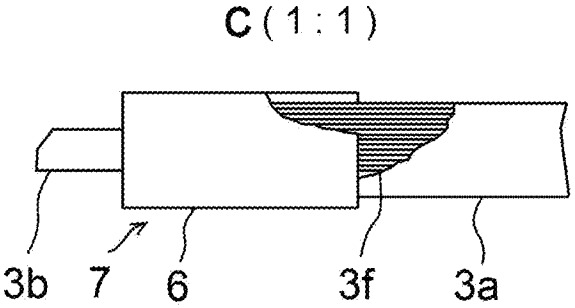

Suitable examples for the mutual fixation of the central rod section 3*a* on the one side and anchoring rod sections 3*b* on the other side are discernible from FIGS. 2 and 3, which shall be explained in greater detail in the following:

FIG. 2 shows an alternative design of a building element 11 for thermal insulation, with here parts identical to those in FIG. 1 being marked with the same reference characters. Similar to the right end 7 of the central rod section 3*a* in FIG. 1, the two free ends 7 of the central rod section 3*a* are also provided respectively with a radial support element 6, indicated in a section C and shown in detail in FIG. 2A.

The radial support element 6 comprises a cylindrical ring, with its interior diameter being only slightly greater than the exterior diameter of the central rod section 3*a* in order to this way allow it contacting the exterior of the central rod section 3*a* in a planar fashion. The detail illustrated in FIG. 2A discloses in a schematic, sectional illustration the design of the central rod section 3*a*: It comprises fiberglass-reinforced synthetic materials with glass fibers 3*f*, which are aligned primarily in the axial direction for compensating and transferring tensile forces. If now the anchoring rod section 3*b*, not shown in FIG. 2 but discernible from FIG. 4, engages via the interior anchoring element the radial interior area of the central rod section 3*a*, here the fibers 3*f* extending in the axial direction cannot provide any strong resistance to potential stress in the radial direction, primarily since these fibers, in the proximity of the free end 7 of the central rod section 3*a*, tend to deflect in the radial direction. In order to prevent this effect, the radial support element 6 is provided, which encompasses the free end 7 of the central rod section 3*a* and prevents any radial deflection of the fibers 3*f*.

Therefore, only the radial support element 6 ensures a resilient and lastingly effective connection of the central rod section to the anchoring rod section.

Figure 3:
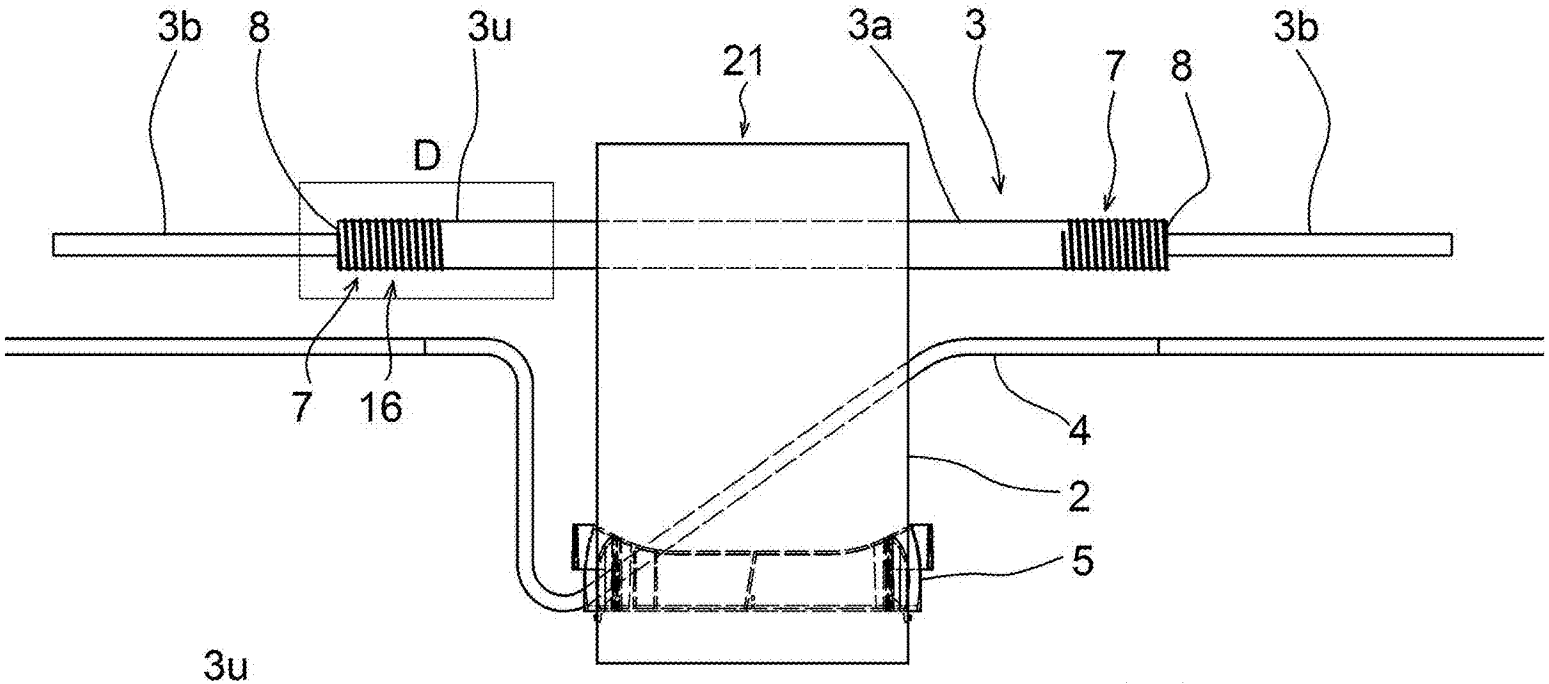
FIGS. 3 and 3A another alternative element for thermal insulation according to the invention with a second embodiment for the mutual fixation of a central rod section and an anchoring rod section according to a second solution according to the invention.

The aspects essential for the invention are also discernible from FIG. 3, which displays another alternative version of an element 21 for thermal insulation, with once more identical components being provided with the same reference characters as in FIGS. 1 and 2. FIG. 3 discloses that the central section 3*a* comprises a radial support section 16 in the area of its radial exterior 3*u*, which serves to prevent any radial widening of the central section 3*b* in the radial support area 16.

Figure 3A:
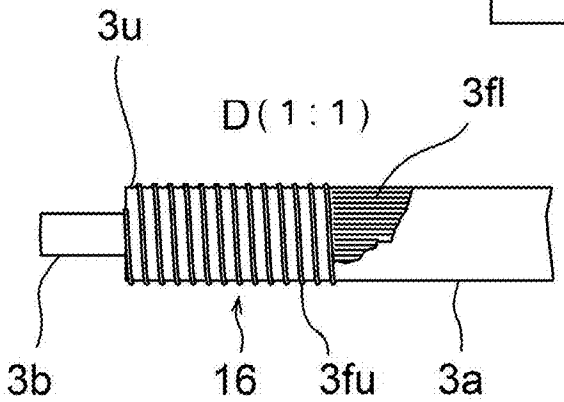

FIG. 3 shows a detail D, illustrated in detail in FIG. 3A. It shows the connection of the anchoring section 3*b* to the central section 3*a* and particularly the radial support area 16. While the central rod section essentially comprises fibers 3*fl*, which are oriented in the axial direction for compensating tensile forces, the radial support area 16 comprises fibers 3*fu* extending in the circumferential direction of the central section 3*a*. These fibers 3*fu* were arranged during the production of the central section 3*a*, in addition to the fibers 3*fl* arranged in the axial direction, in the area, which shall form the radial support area 16.

Adjacent to the anchoring rod section 3*b* at the central rod section 3*a*, not shown in FIG. 3 but discernible from FIG. 4, an interior anchoring element 9 is provided, which on the one side is fixed at the anchoring section 3*b* and on the other side engages a radial interior area of the central rod section 3*a*.

In the same axial section as the interior anchoring element 9, the radial support area 16 is provided with the fibers 3*fu* extending in the circumferential direction of the central section 3*a*.

The radial support area 16 comprises the same and/or an at least similar exterior diameter as the remaining area of the central section 3*a*. For this purpose, for example during the production initially the radially interior area is produced with the fibers 3*fl* extending in the longitudinal direction, and subsequently the radially exterior area is added, with fibers 3*fu* being wound in the circumferential direction in the radial support area 16. Potentially disturbing differences in the exterior diameter between the radial support area 16 and the remaining area of the central section 3*a* may perhaps be filled with matrix material.

Suitable examples for the mutual fastening of the central section and the anchoring section are discernible from FIGS. 4A-4F, which shall be discussed in greater detail in the following, with once more identical components being marked with the same reference characters as in FIGS. 1 to 3. FIGS. 4A-4F respectively show how different embodiments of an internal anchoring element 9 engage a radial internal area, namely a cylindrical bore 3*c* of the central rod section 3*a*.

Figure 4A:
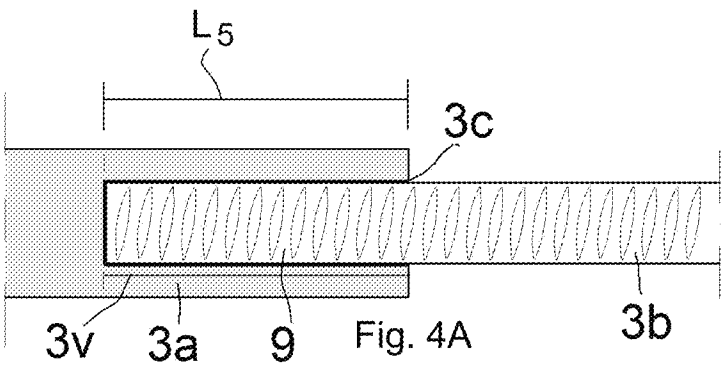
FIGS. 4A-4F additional different embodiments for the mutual fixation of the central rod section and the anchoring rod section.

FIG. 4A shows the insertion and fixation of the interior anchoring element 9 in the central rod section 3*a* by a press connection and/or by the additional use of adhesives in order to actually generate a stable connection, which is suitable to transfer tensile forces. The internal anchoring element 9 extends along an interior anchoring area 3*v* in the radial interior area of the central rod section 3*a*. Its axial length is indicated in FIG. 4A with the reference character $L_5$. In FIG. 4A the radial support area 16 also shows an axial length, which is equivalent to the size $L_5$, with the radial support area 16 in FIGS. 4A-4F being only indicated schematically by the covered boundary line, extending in the radial direction. Consequently the interior anchoring area 3*v* on the one side and the radial support area 16 on the other side overlap each other along the entire axial length $L_5$.

Figure 4B:
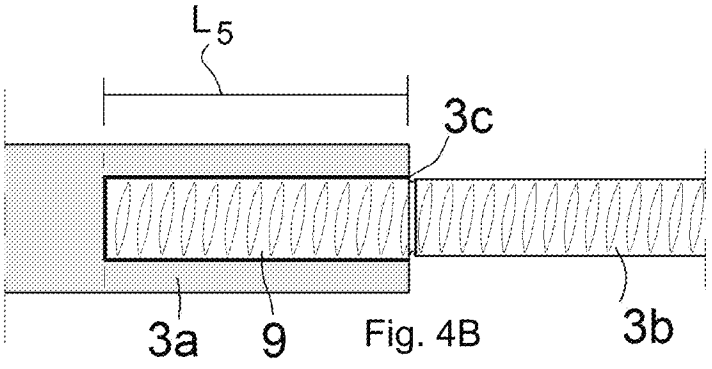

Unlike FIG. 4A, in the embodiment according to FIG. 4B the interior anchoring element 9 represents not a part of the anchoring rod section 3*b* but is welded at the facial side to the anchoring rod section 3*b*. The interior anchoring element 9 can for example be directly laminated therein during the production of the central rod section and only be welded to the anchoring rod section 3*b* at a later point of time. Of course it is also possible to insert a cylindrical bore hole 3*c* into the central rod section 3*a* and to fix the interior anchoring element 9 here, before or after the connection to the anchoring rod section 3*b*, using adhesives, for example.

Figure 4C:
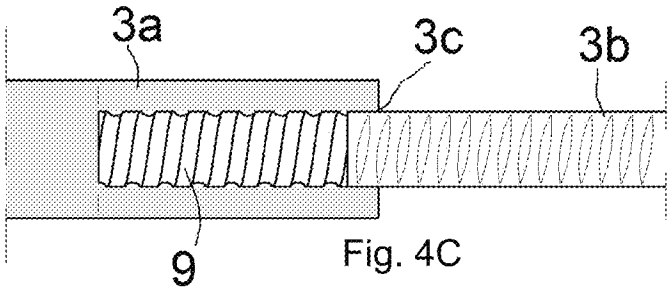

In FIG. 4C the interior anchoring element 9 of the anchoring section 3*b* is provided at its exterior with a profiling, which allows that adhesive, mortar, or similar connecting material are provided with more space here to enter into a positive connection with said profiling in order to allow improving and/or ensuring the mutual connection.

Figure 4D:
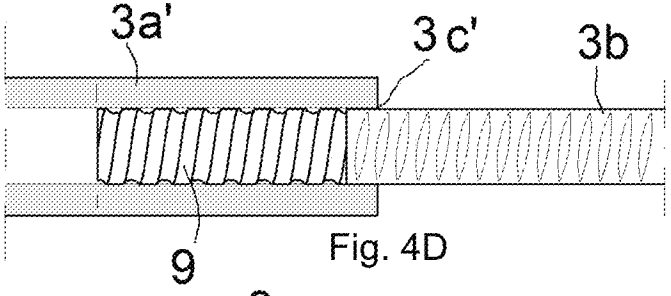
Figure 4E:
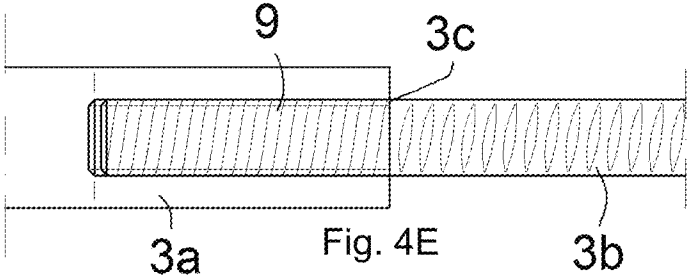

The same profiling at the exterior of the interior anchoring element 9 is provided in the embodiment according to FIG. 4D. The essential difference in reference to the embodiment according to FIG. 4C comprises here that the central rod section 3*a*' is not made from a solid material, in which a cylindrical bore 3*c* is inserted, but from a tubular material with a cylindrical penetrating bore 3*c*'.

In FIG. 4A the interior anchoring element 9 of the anchoring section 3*b* is provided with an external thread and penetrates the cylindrical opening 3*c* of the central section 3*a*, which opening 3*c* in turn comprises an internal thread and this way allows the threaded connection of the anchoring section 3*b* and the central section 3*a*.

Figure 4F:
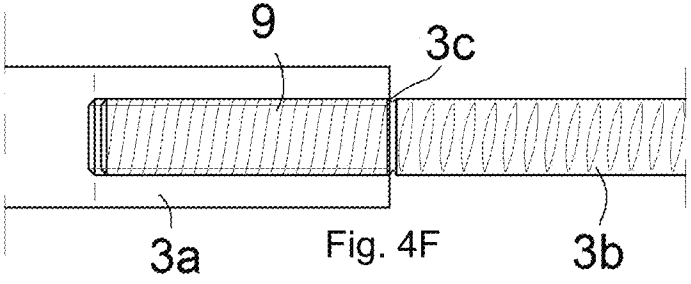

FIG. 4F shows essentially the same embodiment, however with the difference that the interior anchoring element 9 is not formed in one piece with the anchoring rod section but is welded at the facial side to the anchoring rod section 3*b*.

As discernible from FIG. 1, the central section 3*a* extends with its synthetic material far beyond the insulating body and this way allows the anchoring sections 3*b* made from rebar to be welded to the central section 3*a* in such an area 3*n*, which is not at risk for corrosion. This way, essential advantages can be achieved, namely in the area of the insulating body here the particularly advantageous synthetic material of the central section can be used, which is characterized primarily in reference to stainless steel in lower costs and a particularly poor thermal conductivity. And additionally, in the area outside the insulating body, finally in the area of the building parts the anchoring sections may be made from rebar, which has similar temperature expansion coefficients as the construction concrete surrounding it, and thus can generate an optimal connection to the concrete, by which tensile force can be transferred from the concrete into the tensile reinforcement element and vice versa without any otherwise developing destruction occurring caused by excessive relative movements.

In summary, the present invention provides the advantage to provide an element for thermal insulation which comprises tensile reinforcement elements in the form of multi-part composite elements. This way, the various materials can be used precisely according to their characteristics and advantages, which was not possible in this way in prior art and the embodiment according to the invention ensures for the fastening of the anchoring rod sections at the central rod section via a radial support element and/or a radial support section such that the anchoring sections and the central section can be fixed to each other in a simple but resilient fashion.

LIST OF REFERENCE CHARACTERS

1—element for thermal insulation
2—insulating body
3—tensile rods
3*a*—central rod section
3*b*—anchoring rod sections
3*f*—fibers
3*fl*—fibers oriented in the axial direction
3*fu*—fibers oriented in the circumferential direction
3*u*—radial exterior of the central rod section
3*V*—interior anchoring area
4—lateral force rods
5—pressure elements
6—radial support element
7—free end of the central rod section
8—facial side of the central rod section at the free end 7
9—interior anchoring element
11—element for thermal insulation
16—radial support area
21—element for thermal insulation
A—concrete building part
B—concrete building part
C—detail of FIG. 2
D—detail of FIG. 3
$d_M$—diameter of the central rod section
$d_V$—diameter of the anchoring rod section
$L_1$—axial distance of the radial support element from the insulating body
$L_2$—length of the radial support area in the axial direction
$L_3$—size the anchoring rod section extends from the radial support element into the building part A and/or B
$L_4$—axial length of the annular radial support element
$L_5$—size the interior anchoring element extends into the radial interior area of the central rod section 3*a*.

The invention claimed is:

1. An element for thermal insulation between two building parts, comprising an insulating body (2) to be allocated between the two building parts and reinforcement elements including at least rod-shaped tensile reinforcement elements (3), which in an installed state of the element (10) extend essentially horizontally and extend perpendicular to an essentially horizontal extension of the insulating body through said body, and each said rod-shaped tensile reinforcement element projects in a horizontal direction from the insulating body and are here connectable to one of the two building parts, the tensile reinforcement elements (3) being made at least partially from a fiber-reinforced synthetic material and are each embodied as multi-part composite elements that at least in proximity to the insulating body (2) comprise a central rod section (3*a*) made from a fiber reinforced synthetic material and in an area outside the insulating body (2) include a separate anchoring rod section (3*b*) with at least one of geometric or material characteristics at least partially deviating from the central rod section (3*a*), the anchoring rod section (3*b*) and the central rod section are arranged coaxially to each other and are fixed to each other at least indirectly, the anchoring rod section (3*b*) cooperates with an interior anchoring element (9) for fixation to the central rod section (3*a*) and engages a radial interior area of the central rod section (3*a*), a separate annular radial support element (6) located at a radial exterior of the central rod section (3*a*) formed as a separate component from the central rod section (3*a*) and only contacting the central rod section (3*a*) with an inner perimeter of the annular radial support element (6), the central rod section (3*a*) is formed at least in an area between the insulating body (2) and a free end (7) thereof with an essentially smooth, constant outside diameter on a radial exterior, the radial support element (6) is arranged only in an axial area of the central rod section (3*a*) projecting from the insulating body (2), and the radial support element (6) is arranged spaced apart from the insulating body.

2. The element for thermal insulation according to claim 1, wherein the interior anchoring element (9) extends in the radial interior area of the central rod section (3*a*) in an axial direction and the annular radial support element (6) arranged on the radial exterior of the central rod section (3*a*) is arranged at least partially in a same axial area of the central rod section (3*a*).

3. The element for thermal insulation according to claim 1, wherein at least one of the interior anchoring element (9) or the radial support element (6) extend to a free end (7) of the central rod section (3*a*) at which the central rod section (3*a*) is fastened at the anchoring rod section (3*b*).

4. The element for thermal insulation according to claim 1, wherein the annular radial support element comprises a stop projecting inwardly in a radial direction and the stop at least indirectly impinges a face of the central rod section located at a free end of the central rod section.

5. The element for thermal insulation according to claim 1, wherein the annular radial support element (6) is made from metal.

6. An element for thermal insulation between two building parts, comprising an insulating body (2) to be arranged between the two building parts, reinforcement elements including at least rod-shaped tensile reinforcement elements (3), which in an installed state of the building element (10) project horizontally and perpendicularly to an essentially horizontal, longitudinal extension of the insulating body through said body, and each said rod-shaped tensile reinforcement element projects in the horizontal direction from the insulating body, and are here connectable to one of the two building parts, the tensile reinforcement elements (3) at least partially being made from a fiber-reinforced synthetic material and are each embodied as multi-part composite elements including at least in proximity to the insulating body (2) a central rod section (3*a*) made from fiber-reinforced synthetic material and in an area outside the insulating body (2) a separate anchoring rod section (3*b*) with at least one of geometric or material features at least partially deviating from the central rod section (3*a*), the anchoring rod section (3*b*) and the central rod section (3*a*) are arranged aligned towards each other, and are fixable to each other at least indirectly, the anchoring rod section (3*b*) cooperates with an interior anchoring element (9) for fixation to the central rod section (3*a*), said interior anchoring element engages a radial interior area of the central rod section and extends here in an axial direction over an interior anchoring section (3*v*), the central rod section further comprises a radial support area (16) with fibers (3*f*) extending directly on and at least partially in a circumferential direction around the central rod section (3*a*), the interior anchoring section (3*v*) and the radial support area (16) overlap radially, at least partially, the central rod section (3*a*) is formed at least in an area between the insulating body (2) and a free end (7) thereof with an essentially smooth, constant outside diameter on a radial exterior, the radial support area (16) is arranged only in an axial area of the central rod section (3*a*) projecting from the insulating body (2), and the radial support area (16) is arranged spaced apart from the insulating body.

7. The element for thermal insulation according to claim 6, wherein the interior anchoring area (3*v*) and the radial support area (16) are arranged at least partially in a same axial section of the central rod section.

8. The element for thermal insulation according to claim 6, wherein at least one of the interior anchoring area (3*v*) or the radial support area (16) extend to a free end (7) of the central rod section (3*a*) at which the central rod section (3*a*) is fixed to the anchoring rod section (3*b*).

9. The element for thermal insulation according to claim 6, wherein the radial support area (16) is arranged in a radial exterior area (3*u*) of the central rod section (3*a*).

10. The element for thermal insulation according to claim 6, wherein the fibers (3*fu*) extending at least partially in a circumferential direction in the central rod section (3*a*) are fiberglass.

11. The element for thermal insulation according to claim 6, wherein two of the anchoring rod sections (3*b*) are provided, with one being located at each of the free ends (7) of the central rod section (3*a*).

12. The element for thermal insulation according to claim 6, wherein at least one of (a) the rod-shaped central rod section (3*a*) comprises at least one of a solid or tubular material, or (b) the rod-shaped central rod section (3*a*) is made from a fiberglass reinforced synthetic material.

13. The element for thermal insulation according to claim 6, wherein the anchoring rod section (3*b*) is made from at least one of steel or fiber reinforced synthetic material.

14. The element for thermal insulation according to claim 6, wherein the interior anchoring element (9) in the central rod section (3*a*) is fixed in at least one of a form-fitting, force-fitting, or material-to-material fashion, via at least one of an adhesive connection, a threaded connection, or formed connection by the interior anchoring element (9) being formed in the central rod section (3*a*).

15. The element for thermal insulation according to claim 6, wherein the interior anchoring element (9) is fixed in at least one of a form-fitting, force-fitting, or material-to-material fashion, via at least one of (a) a welding connection to the anchoring rod section (3*b*), the interior anchoring element (9) being formed in one piece at the anchoring rod section (3*b*) or representing a part of the anchoring rod section (3*b*).

16. The element for thermal insulation according to claim 6, wherein the interior anchoring element (9) engages over an axial length ($L_5$) of a radial interior area of the central rod section, which is at least 4-times a size of a diameter ($d_M$) of the central rod section (3*a*).

17. The element for thermal insulation according to claim 1, wherein the annular radial support element has a length ($L_4$) in an axial direction that is at least 1.5 times a size of a diameter ($d_M$) of the central rod section (3*a*).

18. The element for thermal insulation according to claim 6, wherein the radial support area (16) comprises fibers (efu) extending at least partially in the circumferential direction of the central rod section (3*a*) having a length ($L_2$) in the horizontal direction that is at least 1.5 times and maximally 15-times a size of the diameter ($d_V$) of the anchoring section (3*b*).

19. Then element for thermal insulation according to claim 6, wherein the element for thermal insulation (1), in addition to the tensile reinforcement elements (3), has at least one of compression elements (5) or lateral force elements (4).

* * * * *